US010501234B2

(12) United States Patent
McGrade et al.

(10) Patent No.: US 10,501,234 B2
(45) Date of Patent: Dec. 10, 2019

(54) BEVERAGE CAN SANITARY SEAL

(71) Applicants: Michael McGrade, West Covina, CA (US); Gavin McGrade, West Covina, CA (US)

(72) Inventors: Michael McGrade, West Covina, CA (US); Gavin McGrade, West Covina, CA (US)

( * ) Notice: Subject to any disclaimer, the term of this patent is extended or adjusted under 35 U.S.C. 154(b) by 474 days.

(21) Appl. No.: 15/153,068

(22) Filed: May 12, 2016

(65) Prior Publication Data

US 2017/0327274 A1 Nov. 16, 2017

(51) Int. Cl.
*B65D 25/20* (2006.01)

(52) U.S. Cl.
CPC ..... *B65D 25/20* (2013.01)

(58) Field of Classification Search
CPC ..... B65D 17/00; B65D 17/50; B65D 51/20; B65D 51/18; B65D 25/20
See application file for complete search history.

(56) References Cited

U.S. PATENT DOCUMENTS 3,438,533 A * 4/1969 Hanisch ..... B65D 17/12 220/257.2
4,651,890 A * 3/1987 Coker ..... B08B 1/00 215/6
5,014,869 A 5/1991 Hammond
5,108,003 A * 4/1992 Granofsky ..... B65D 17/506 220/257.2
5,143,241 A 9/1992 Szymanski
5,346,088 A * 9/1994 Brimo, II ..... B65D 51/20 220/694
6,015,059 A 1/2000 Takayama
6,073,797 A 6/2000 Barous
6,241,114 B1 * 6/2001 Savino ..... B65D 21/022 206/459.5
6,321,927 B2 11/2001 Cavella
8,534,490 B2 * 9/2013 Chapin ..... B65D 25/34 220/729

* cited by examiner

*Primary Examiner* — Andrew T Kirsch
(74) *Attorney, Agent, or Firm* — Mark S. Hubert

(57) ABSTRACT

A unitary, single-use, sanitary seal for a beverage can. It has a number of redundant sealing interfaces incorporated into its design and uses of both friction fit and captive seals. It may be installed at the canning facility or elsewhere by a third party, with or without the use of heating. Its dome construction flexes the side walls and seals outward in an expansive manner to allow installation. To remove, the seal must be destroyed, leaving a visual indication. It allows a conventional six-pack ring to be used as well as the vertical stacking of groupings of cans. Antibacterial agents such as silver, copper, zinc, tin, or the like may optionally be incorporated into the seal's material to enhance or maintain sterility.

7 Claims, 7 Drawing Sheets

BEVERAGE CAN SANITARY SEAL

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to sanitary seals, and more particularly to single use, sanitary seals for beverage cans.

BACKGROUND

Pop, juice, beer and the like are generally shipped, stocked and sold naked. That is to say with their bare, aluminum or metal cans as the only barrier between the consumer and the fluid contained inside. This gives rise to the possibility of contaminants in biological, chemical and particulate form, depositing on the area of the can where the consumer either places their lips to drink, or pours the contents out into a glass.

There is a plethora of prior art in the field of can seals. These range from simple foil seals adhesively affixed across the upper rim of the can, to complex design reusable polymer lids. The problem is that many of the designs have to be put on by the canner (bottler) at their filling facility and cannot be performed at a different location by third parties (such as the store itself.) The major problem with the existing can seals is that they have but a minimal number of seals, and the seals are all of the same style. This makes a breach of the integrity of the seal quite simple. Further, most of the seals currently on the market do not protect the can's upper skirt, can be replaced after the seal has been breached, and do not indicate a breach. Non sanitary related problems are: they cant be utilized with six-pack rings; they do not allow for vertical stacking; and they can be easily dislodged in shipping and storage. Lastly, adhesively fixed seals can leave residual adhesive after the seal has been removed or can dislodge in warm weather.

A higher level of seal integrity coupled with a seal that allows for conventional shipping and storage methodology, would provide a huge leap forward in minimizing or eliminating the contaminants on the top face and side skirt of beverage cans. This can only be accomplished with a non-reusable seal having multiple sealing interfaces of differing designs that strongly affixes in a non adhesive manner to the beverage can.

Henceforth, an improved beverage can sanitary seal that would overcome the above mentioned failures of the prior art would fulfill a long felt need in the beverage industry. This new invention utilizes and combines known and new technologies in a unique and novel configuration to overcome the aforementioned problems and accomplish this.

BRIEF SUMMARY

In accordance with various embodiments, a single use beverage can seal having multiple seal interfaces and employing differing styles of seals including vacuum seals, friction fit seals and captive seals that still allow the can to conform to the conventional methods of shipping and storage, is provided.

In one aspect, an improved beverage can seal that can protect the top face and the side skirt of a beverage can from contaminants is provided.

In another aspect, an improved beverage can seal is provided, capable of accommodating a multi can ring and vertical stacking, is provided.

In yet another aspect, an improved beverage can seal that holds its position on the can stronger than existing can seals and that must be visually destroyed upon breaching its integrity, is provided.

In yet another aspect, a beverage can seal that may be installed with or without the application of heat and at a location other than the canning facility is provided.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

DETAILED DESCRIPTION

Figure 1:
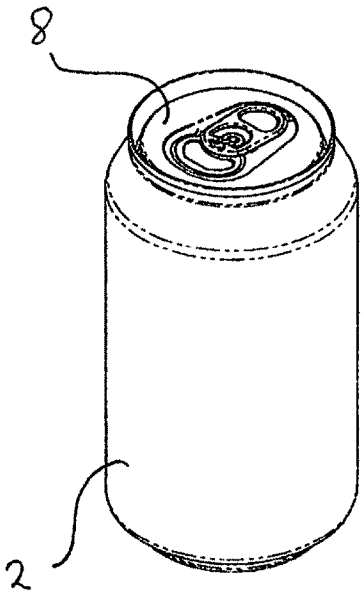
FIG 1 Prior Art
FIG. 1 is a perspective side view of a conventional beverage can.
Figure 4:
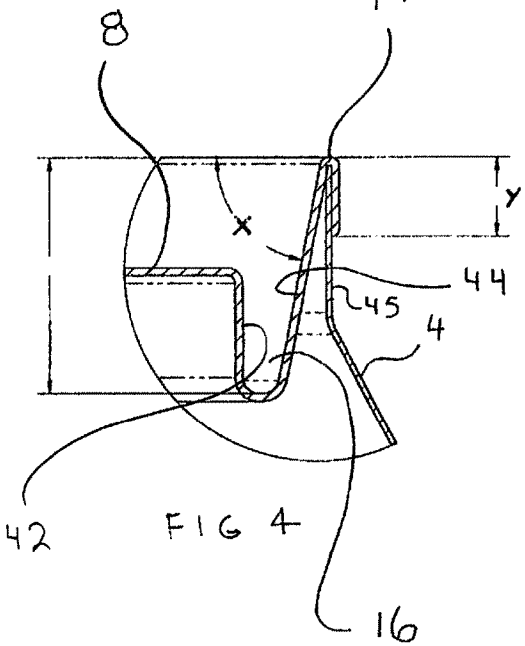
FIG 4 Prior Art
FIG. 4 is a cross sectional view of a conventional beverage can showing section B of FIG. 3.
Figure 2:
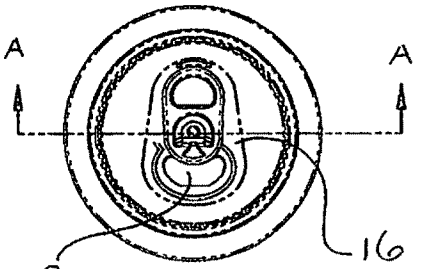
FIG 2 Prior Art
FIG. 2 is a top view of a conventional beverage can.
Figure 3:
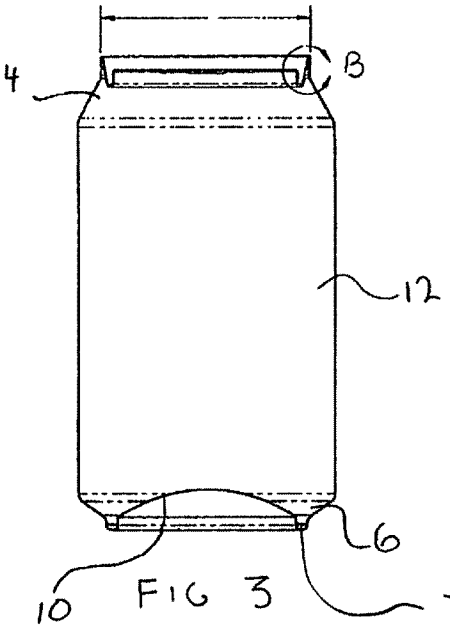
FIG 3 Prior Art
FIG. 3 is a side cross sectional view of a conventional beverage can through section A-A of FIG. 2.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

The term "captive seal" as used herein, refers to a style of seal or method of making a seal accomplished by contact between two matingly conformed surfaces but does not involve the deformation (elastic or inelastic), of the material of either surface. An example of this would be of an aluminum foil lid across a yogurt container.

The term "friction fit seal" as used herein, refers to a style of seal or method of making a seal between two objects wherein the seal occurs by the deformation, compression or deflection of at least some of the material of one of objects at the seal interface. An example of this type of seal is that of a windshield wiper blade on a vehicle's window.

The term "vacuum seal" as used herein, refers to a style of seal or method of making a seal wherein the integrity of the seal achieved at the sealing interface is partially maintained by an enclosed, sealed volume of air bounded by the two objects and the sealing interface, wherein that volume of air has a lesser pressure that that of the ambient atmosphere.

The term "sealing interface" as used herein, refers to the region where the seal and the container to be sealed are in direct physical contact with each other so as to prevent the transfer of contaminants in at least one direction past this region of contact.

The term "vacuum" as used herein refers to any pressure in an enclosed area that is lesser than the ambient atmospheric pressure.

The term "conventional six-pack ring" as used herein, refers to the polymer six holed lanyard that encircles the side wall of a series of six substantially similar beverage cans yet cannot pass beyond the crimp rims of the cans without deformation.

The term "sanitizing solution" as used herein refers to a liquid with sanitizing properties such as sterilization or disinfection that is compatible and safe for contact with the drinking surfaces of a beverage can. Ethanol diluted with water would be an example of such a sanitizing solution.

The present invention relates to a novel design for a unitary, single-use, sanitary seal for a beverage can. It may be installed at the canning facility or elsewhere by a third party, with or without the use of heating. To remove, the seal is held so tightly to the can by the combination of the multiple seals that it will have to be destroyed, giving a visual indication of a breach. It is designed to allow a conventional six-pack ring to be used with the seal as well as vertical stacking of individual or groupings of cans. Antibacterial agents such as silver, copper, zinc, tin, or the like may optionally be incorporated into the seal's material to enhance or maintain sterility. The series of embodiments provided herein, provide superior sanitary sealing performance compared to the prior art because of the number of redundant sealing interfaces incorporated, and because of the use of multiple types of seals including vacuum seals, friction fit seals and captive seals.

Looking at FIGS. 1-4, the physical structure of the conventional beverage can 2 is best illustrated. The can 2 is of a right circular cylindrical configuration commonly having a top end wall 8 and a spatially opposed domed bottom end wall 10 bounded by bottom ring 7. Transitioning between the right circular cylindrical region 12 and the end walls is an axially inward tapered, upper skit 4 with an upper band 45, and a shorter, axially inward tapered, lower skirt 6. The bottom end wall 10 and right cylindrical regions 12 of the can (or the tapered lower skirt 6, if so provided) are commonly formed from a single piece of aluminum, tin or steel although they may be formed from two conjoined separate pieces. The top end wall 8 is a separate piece wherein the outer periphery of the top end wall 8 and the outer periphery of the right cylindrical regions 12 of the can (or the tapered upper skirt 4, if so provided) are mechanically compressed (crimped) together into a crimp rim 14, which is surrounded by a rim gutter 16 (with an inner gutter side wall 42 and an outer gutter side wall 44). The rim gutter forms a trough around the generally planar remainder of the top end wall 8. In the central region of the top end wall 8, there is a pull tab 17 that hingedly opens a door 18 into the enclosed volume of the can 2. The pull tab 17 resides atop the upper face of the top end wall 8. The angle between the long, outer wall of the rim gutter and the plane of the top end wall 8 (designated as angle X) generally is 79 degrees. The length of the crimped region (designated as length Y) generally is 0.100 inches.

Figure 5:
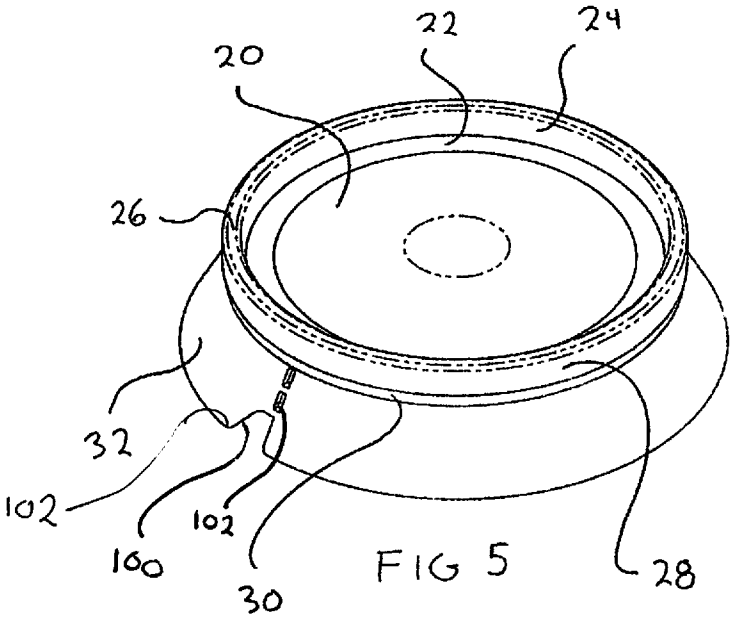
FIG. 5 is a side perspective view of the first, second or third embodiment sanitary seal.
Figure 6:
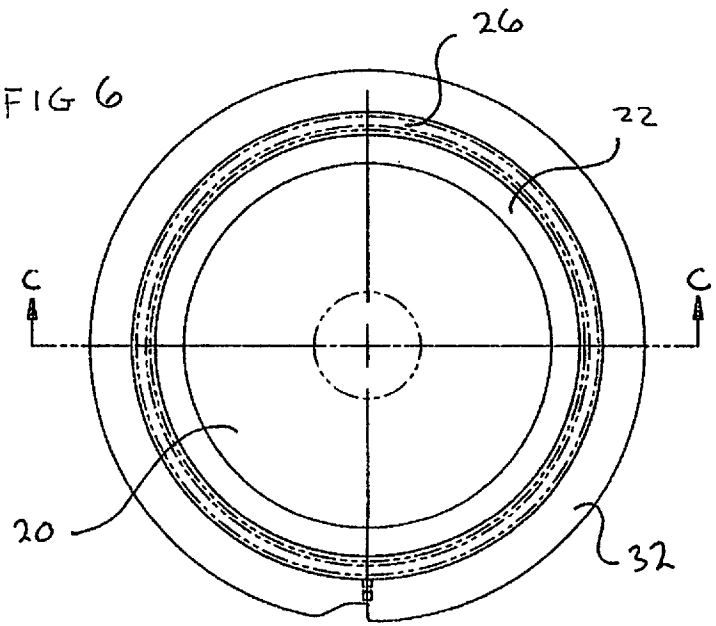
FIG. 6 is a top view of the first, second or third embodiment sanitary seal.
Figure 10:
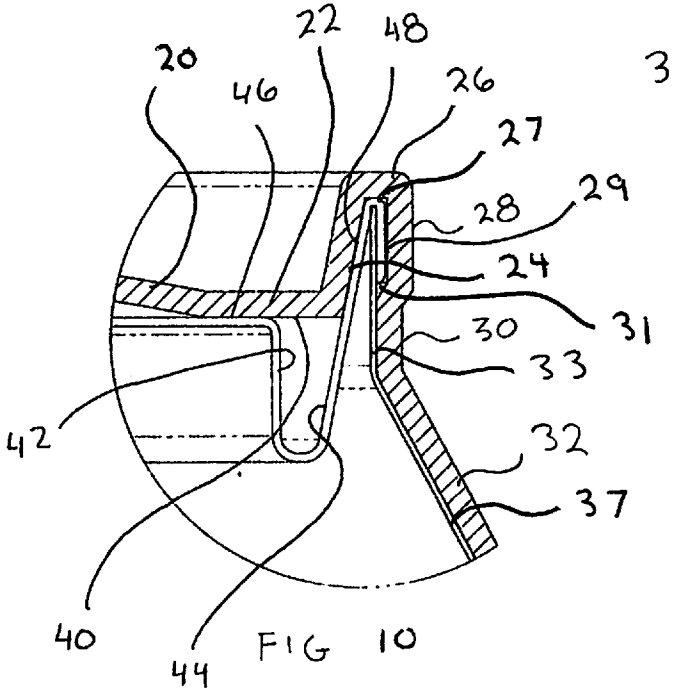
FIG. 10 is a side cross sectional view of the first embodiment sanitary seal showing section E of FIG. 9.
Figure 8:
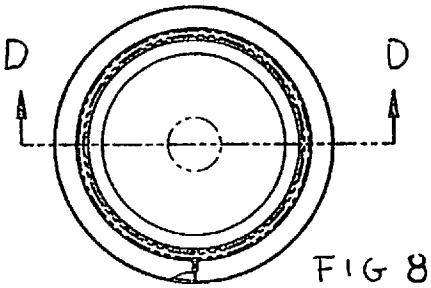
FIG. 8 is a top view of any of the first, second or third embodiment sanitary seal installed on a conventional beverage can.
Figure 9:
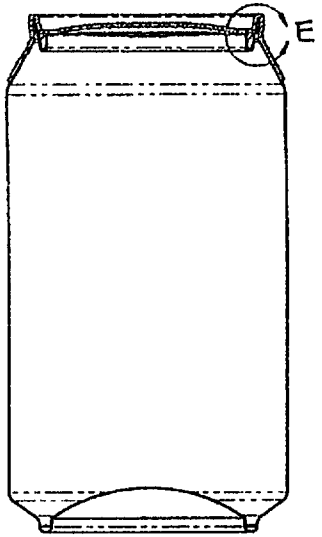
FIG. 9 is a side cross sectional view of the first embodiment sanitary seal through section D-D of FIG. 8.

Looking at FIGS. 5-6 the exterior view of the first, second and third embodiments of the sanitary seal can be seen. It is to be noted that these embodiments, although differing in their interior friction fit seal design, (or lack thereof as in the first embodiment) are visibly indistinguishable when viewed from the top, side or on a can. Simply stated, they are of a circular cylindrical configuration with a single closed, dome-shaped end and having a peripheral flange that has an axially tapered side wall (resembling a section of a truncated cone) extending therefrom. The domed top 20 has a planar circumferential seal ring 22 terminated by an inner side wall 24 extending upwards at the approximate same 79 degree angle as the rim gutter outer side wall 44. (Designated as X in FIG. 4.) At the top of the inner side wall 24 is a top horizontal lip 26, the outer edge of which returns downward forming a flange with an outer ring 28 which necks axially inward to a smaller diameter capture band 30. The capture band 30 of this flange abuts an axially outward tapered skirt shield ring 32 approximately 72 degrees from the vertical plane (FIG. 10) This 72 degrees is the same angle found on the upper skirt 4. (designated as angle Z in FIG. 17).

The fourth embodiment of the sanitary seal differs visually when viewed from the top only in that there is an additional seal crease 34 (FIG. 16) on the top horizontal lip 26. This crease resides between the inner side 46 and outer side of the U trough seal. This crease allows the inward flexion of the friction fit seal so as to allowing it to conform to the rim gutter side walls.

FIGS. 7-10 show the details of the first embodiment sanitary seal 36. The sanitary seal is made of a single layer construction as can be seen in the cross sectional drawings of FIGS. 17, 14, 12, 10 and 16. The first embodiment 36 has an upwardly domed top 20 with sufficient vertical lift to clear the pull-tab 17 and still have a gap for the inward flexion of the dome 20. The dome extends across the entire width of the top terminating at a seal ring 22. The seal ring having a planer inner face 40 that contacts the top end wall 8 (forming a vacuum seal 46) and spanning across the rim gutter 16, terminating at the rim gutter outer side wall 44. Extending vertically from the outermost edge of the seal ring 22, upward at the approximate same 79 degree angle as the rim gutter outer side wall 44, is the inner side wall 24. This inner side wall 24 contacts the rim gutter side wall 44 (forming a first friction seal 48). At the top of the inner side wall 24 is the horizontal lip 26 of a thickness to span the crimp rim 14 with its inner face in contact with the top edge of the crimp rim 14 (forming a second, friction seal 27). The outer edge of the horizontal lip 26 returns downward forming the outer ring 28 that contacts the circular, exposed side wall of the crimp rim (forming the third, friction seal 29). The outer ring 28 then necks down in both inside and outside diameter into a smaller diameter capture band 30. This necked down region has a smaller diameter and angles axially outward in a skirt shield ring 32. The capture band 30 encircles the can and forms two seals. The fourth, capture seal 31 occurs where the capture band 30 contacts the crimp rim bottom edge, and the fifth, capture seal 33 occurs where it contacts the can's upper band 45. The skirt shield ring 32 rests on the upper skirt 4 (forming the sixth capture seal 37). There is a cutaway 100 on the skirt shield ring 32 with a series of adjacent, aligned tear perforations 102.

Here, it can be seen that the first embodiment has a total of seven seals and sealing interfaces, the innermost is the vacuum seal, followed by six captive seals.

The second, third and fourth embodiments differ from the first embodiment only by the inclusion of a single or double friction fit seal between the vacuum seal and the first capture seal.

Figure 12:
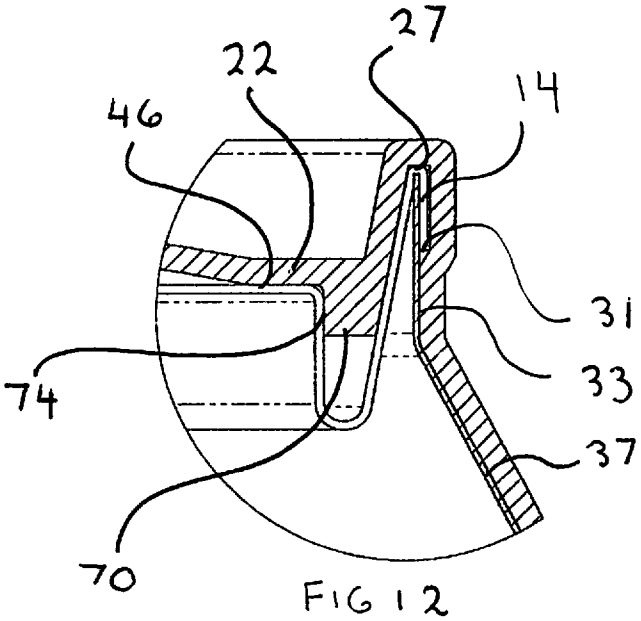
FIG. 12 is a side cross sectional view of the second embodiment sanitary seal showing section H of FIG. 11.
Figure 11:
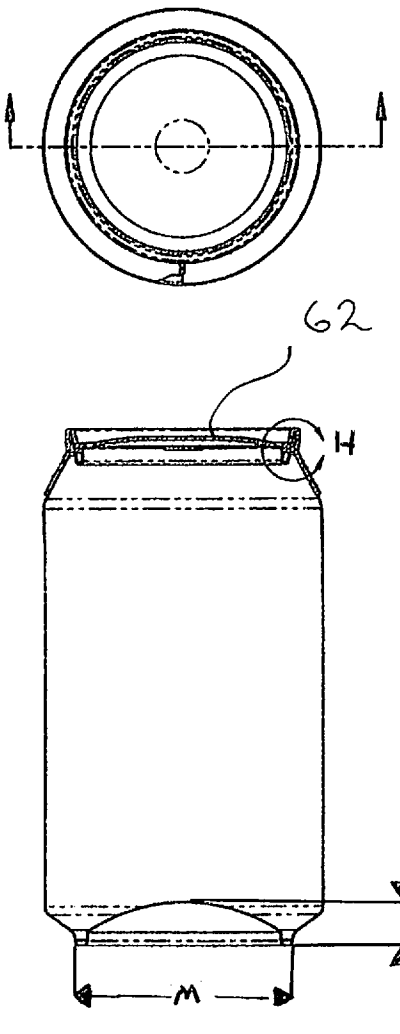
FIG. 11 is a side cross sectional view of the second embodiment sanitary seal installed on a conventional beverage can.

FIGS. 11-12 show the details of the second embodiment sanitary seal 36. Here, the addition of a slightly compressible, single plug ring 70 projecting downward from the outer edge of the circular seal ring where the inner side wall 24 meets the circular seal ring and extends at its upward angle. This plug ring 70 incorporates a first friction fit seal 74 formed between the gutter 16 and the sides of the plug ring 70. This tapered plug ring 70 is forcefully wedged into the gutter 16 with enough pressure to cause some compression and or deformation of the plug to allow it to contour to the gutter walls and form the seal 74. Thus, the second embodiment has a total of eight sealing interfaces, the innermost, a vacuum seal followed by a single friction fit seal and six captive seals.

Figure 17:
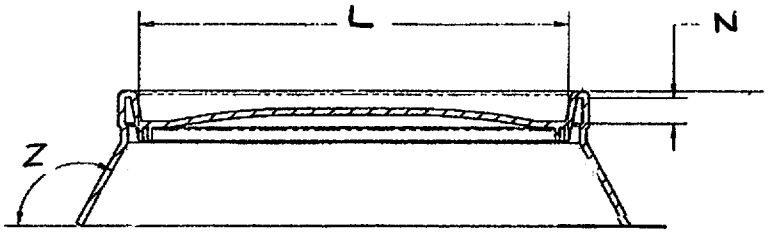
FIG. 17 is a side cross sectional view of the third embodiment of the sanitary seal.
Figure 7:
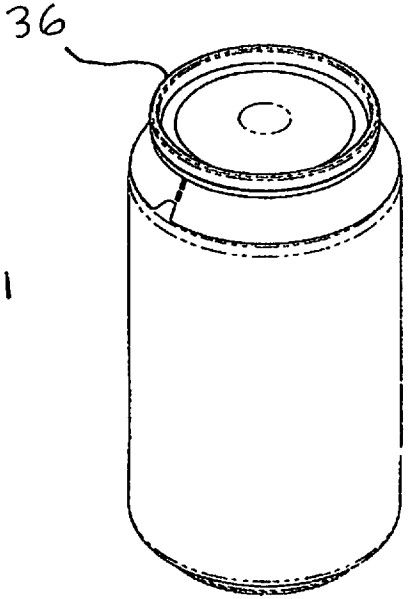
FIG. 7 is a perspective side view of a conventional beverage can with any of the first, second or third embodiment sanitary seals installed.
Figure 14:
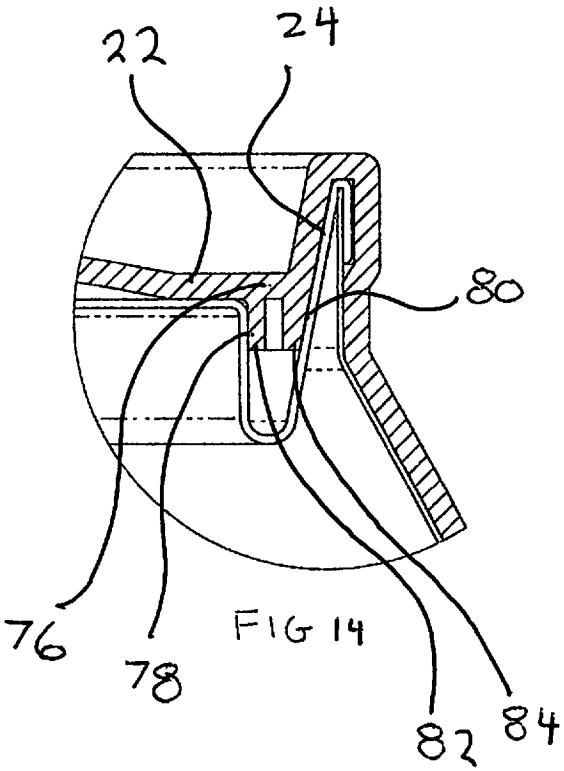
FIG. 14 is a side cross sectional view of the third embodiment sanitary seal showing section F of FIG. 13.
Figure 13:
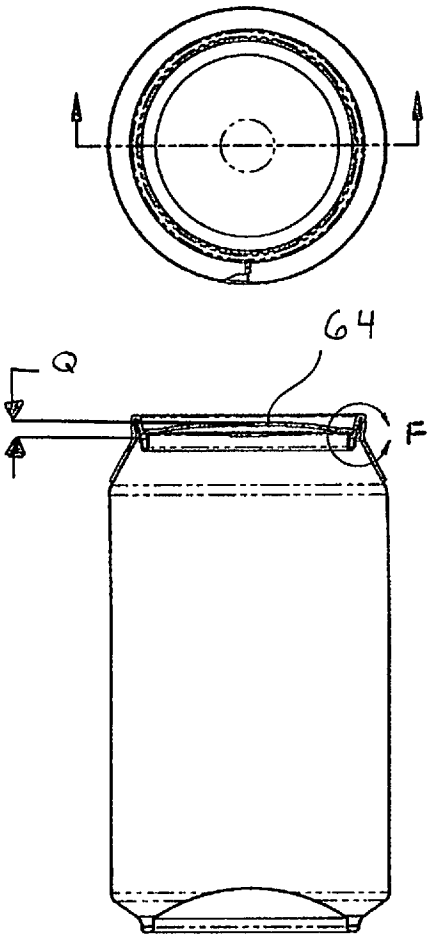
FIG. 13 is a side cross sectional view of the third embodiment sanitary seal installed on a conventional beverage can.

FIGS. 13-14 and 17 show the details of the third embodiment sanitary seal 64. Here, the addition of a wiper ring 76 comprised of a flexible, compressible inner ring 82 and a flexible, compressible outer ring 84 held in a an adjacent parallel spaced configuration that constitutes a second friction fit seal 78 and a third friction fit seal 80 formed between the gutter 16 and the sides of the inner and outer rings. The compressible outer ring is formed at the bottom corner of the inner side wall and the compressible inner ring projects downward from the seal ring 22, adjacent and parallel to the compressible outer ring 84. This wiper ring 76 is forcefully wedged into the gutter 16 with enough pressure to cause some compression and or deformation of both the inner and outer rings 82 and 84, allowing it to contour to the gutter walls and form the second and third friction fit seals 78 and 80. The third embodiment has a total of nine sealing interfaces, the innermost, a vacuum seal followed by two friction fit seals and six captive seals.

Figure 16:
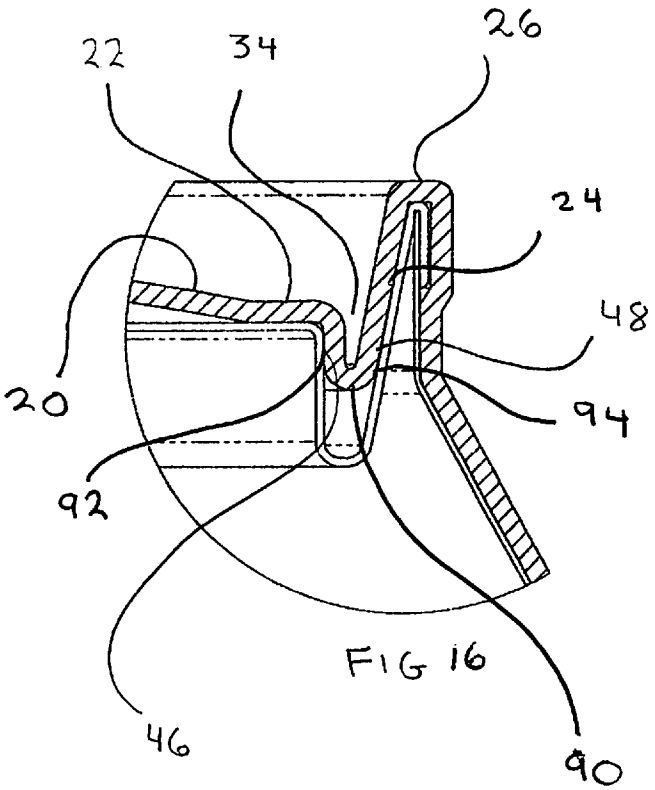
FIG. 16 is a side cross sectional view of the fourth embodiment sanitary seal showing section G of FIG. 15.
Figure 15:
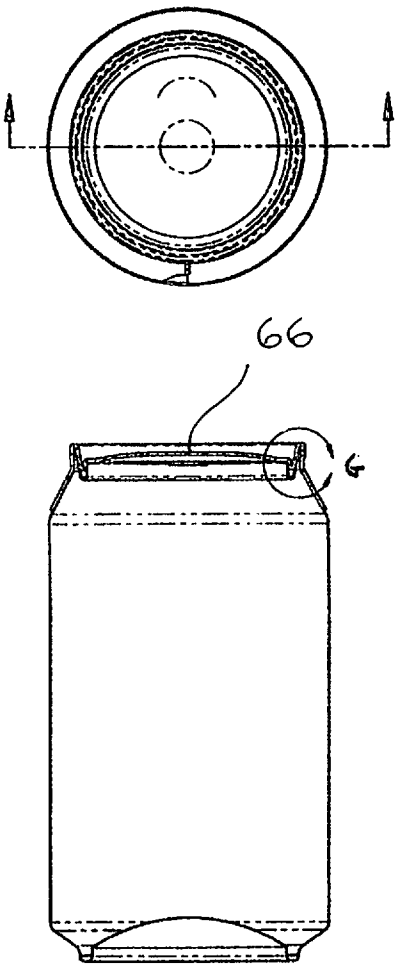
FIG. 15 is a side cross sectional view of the fourth embodiment sanitary seal installed on a conventional beverage can.

FIGS. 15-16 show the details of the fourth embodiment sanitary seal 66. Here, the addition of a corrugated wiper ring 90 comprised of a flexible, compressible "U" shaped plug that is formed at the interface between the seal ring 22 and the inner side wall 24, constitute a fourth friction fit seal 92 and a fifth friction fit seal 94 formed between the gutter 16 and the sides of the corrugated wiper ring 90. This corrugated wiper ring 90 is forcefully wedged into the gutter 16 with enough pressure to cause the distance between the inner sides of the "U" to narrow, allowing the outer sides of the "U" to contour to the gutter walls and form the fourth and fifth friction fit seals 92 and 94. Here, it can be seen that the fourth embodiment has a total of nine sealing interfaces, the innermost, a vacuum seal followed by two friction fit seals and six captive seals.

Figure 18:
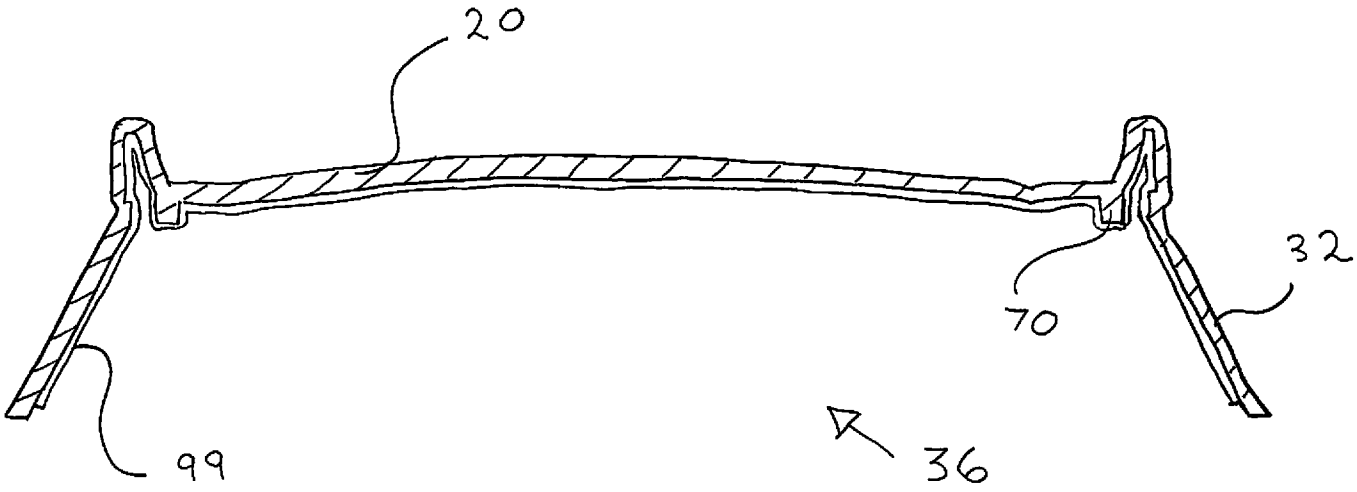
FIG. 18 is a side cross sectional view of the second embodiment sanitary seal showing the optional, inner antiseptic cloth liner.

FIG. 18 shows the second embodiment sanitary seal 36 with the optional inner sanitizing cloth cover 99 affixed to its inner face. This thin planar cloth cover 99 is made of an absorbent material that can retain a food grade liquid with either/or antiseptic or disinfectant properties within its thickness, and yet hold an adhesive on its inner face. The cloth cover may be of a two ply construction of an absorbent outer paper fiber cloth adjoined to a thin polymer inner backing. The adhesive resides between the inner face of the inner backing and the inner surface of sanitary seal 36. The cloth cover 99 when installed, resides on the inner surface of the sanitary seal, extending from the skirt shield ring 32, across the plug ring 70 and to the center of the dome 20. It may similarly be utilized on all embodiments of the sanitary seal. This is an excellent option for installation on beverage cans after they have left the bottler/canner and where there has been the possibility of the introduction of a surface contaminant. The act of compressing the sanitary seal onto a can squeezes some of the antiseptic or disinfectant from the absorbent outer paper fiber cloth and onto the can. Twisting the sanitary seal during or after installation will enhance the sterilizing of the can. In sanitary seal embodiments with the cloth cover 99 are envisioned to be of a minimal thickness such that the same sized sanitary seals may be fit onto a beverage can with or without the cloth cover.

All embodiments of the sanitary seal are put in place with the application of downward force on the approximate center of the dome 20. The sanitary seal 2 is placed atop of the can resting the inside face of the skirt shield ring 32 on the crimp rim 14 of the can and a downward force is applied to the outside center of the dome 20 until the sanitary seal 2 pops into place.

The domed top 20 of all embodiments flexes slightly inward (decreasing the dome's concavity) when a downward force is applied to the approximate center of the dome's outside (top) face. Applying such a force facilitates several physical actions.

First, it slightly increases the diameter of the horizontal lip 26, the outer ring 28, the capture band 30 and the skirt shield ring 32. (Illustrated as an increase in the distance designated by A in FIG. 17.) This allows the smaller diameter of the capture band 30 to pass over and beyond the larger diameter of the can's crimp ring 14 far enough so that the top shoulder 50 of the capture band 30 can abut the bottom shoulder of the crimped ring, and the side wall 52 of the capture band 30 can contact the side wall of the can above the skirt 4. Thus, the sanitary seal 2 can fit over the crimp rim 14 of the can until the inner, top surface of the outer ring 28 abuts the top of the crimp rim 14. When this downward force on the dome 20 is removed, the diameter of the horizontal lip 26, the outer ring 28, the capture band 30 and the skirt shield ring 32 elastically return to their unstressed diameters so as to establish tight contact at all of their seal interfaces.

Second, this downward force on the dome 20 slightly changes the angle of the outer ring 28, the capture band 30 and the skirt shield ring 32 with respect to the side wall of the can. This allows the sanitary seal 2 to be installed over the crimp rim 14 with lesser friction, as full contact between the sealing surfaces of the sanitary seal 2 and the can (at the sealing interfaces) will not have been made until the pressure on the top of the dome 20 is removed. These two features allow the sanitary seal 2 to dimensionally accommodate clearance for installation over the can.

Third, the downward pressure on the dome 20 forces the seal ring 22 into contact with the top end wall 8 of the can, and simultaneously forces the friction fit seals into the rim gutter 16 and into compression or deformation with the inner gutter side wall 42 and the outer gutter side wall 44.

Lastly, since the seal ring 22 and any friction fit seals in the rim gutter 16 contact their sealing surfaces with the dome slightly compressed and having a loss of concavity, when the force is released the dome 20 will elastically deform back to its original concavity, therein forming a slight vacuum under the dome 20 with respect to atmospheric pressure. This slight vacuum helps hold the sanitary seal 2 to the can and maintain the sealing interface between the top end wall 8 and the seal ring 22, and the rim gutter 16 and any friction seals.

Alternatively, the sanitary seal 2 may be heated until its various diameters expand to allow installation over crimp rim 14. Since, under this second method, the sanitary seal 2 is installed hot, as it cools, the air under the dome will also contract and pull a slight vacuum between the dome 20 and the top end wall 6, helping the sanitary seal 2 adhere to the can.

To remove the sanitary seal 2 from a can, the sealing forces of the multiple seals combine to hold the seal in place to the extent that removal is only by the upward pulling motion on the tab 102 at the exposed corner of the cutaway 100 (FIG. 5) on the skirt shield ring 32 causing the sanitary seal to tear along perforations 102 and break the individual seals to release the can from seal 2. This is one of the reasons that multiple seals and sealing interfaces are used.

Since the capture band 30 has an outer diameter that is lesser than the outside diameter of the crimp rim 14 and it resides underneath the bottom edge of the rim, conventional six-pack rings can still be used at this point of narrowing. The capture band is thus dimensionally sized for engagement with a conventional six-pack ring.

It is to be noted that the diameter of the of the dome 20 and the seal ring 22 (designated by L in FIG. 17) exceeds the outer diameter of the can's bottom ring 7 (designated by M in FIG. 11), and the height of the dome 20 (designated as Q in FIG. 13), is less than the height of the concavity of the bottom of the can (designated as P in FIG. 11), so as to allow stacking of the cans with the sanitary seal 2 installed. The height of the inner side wall 24 (designated as N in FIG. 17), prevents the top stacked cans from slipping off.

The material of construction is a polymer and it may have antibacterial agents such as silver, copper, zinc, tin, or the like may optionally be incorporated into the seal's material to enhance or maintain sterility. Optionally, the sanitary seal 2 may undergo a surface coating from any of a plethora of liquid sanitizers known in the industry, to sanitize the seal prior to installation.

While certain features and aspects have been described with respect to exemplary embodiments, one skilled in the art will recognize that numerous modifications are possible. Further, while various methods and processes described herein may be described with respect to particular structural and/or functional components for ease of description, methods provided by various embodiments are not limited to any particular structural and/or functional architecture, but instead can be implemented on any suitable structure. Similarly, while certain functionality is ascribed to certain system components, unless the context dictates otherwise, this functionality can be distributed among various other system components in accordance with the several embodiments.

System components described according to a particular structural architecture may be organized in alternative structural architectures and/or incorporated within other embodiments. Hence, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

Having thus described the invention, what is claimed as new and desired to be secured by Letters Patent is as follows:

1. A single use sanitary seal for a beverage can, said can having a bottom end wall connected to a cylindrical side wall that has an axially tapered; upper skirt adjacent an upper band that is affixed to a top end wall with a crimp rim where said top end wall has a rim gutter forming a circular trough around said top end wall, adjacent said crimp rim; said sanitary seal comprising:

a cylindrical body with a closed top thereon having an upward circular dome formed across an entire width of said closed top;

a generally planar, circular seal ring formed about a circumferential perimeter of said domed top;

an inner side wall extending upward at an angle from a circular edge of said circular seal ring;

a horizontal lip extending from a peripheral circular edge of said inner side wall;

a flange extending from said horizontal lip;

an axially tapered side wall skirt shield ring extending from said flange;

a wiper ring having a compressible inner ring extending downward from an inner surface of said seal ring, and a compressible outer ring formed at a bottom corner of said inner side wall, wherein said inner ring and said outer ring are adjacent and in a spaced configuration with each sized for frictional sealing engagement within said rim gutter of said beverage can; and wherein said flange has an outer ring which narrows and angles inward to form a smaller diameter capture band, and wherein said flange is dimensioned for complete contact with all external surfaces of said crimp rim, said outer ring contacting a circular exposed side wall of said crimp rim, and said capture band contacting a bottom edge of said crimp rim; and wherein said capture band also contacts said can's upper band and is dimensionally sized for engagement with a conventional six-pack ring.

2. The sanitary seal of claim 1 wherein said inner ring and said outer rings are compressible.

3. The sanitary seal of claim 1 having nine separate sealing interfaces when placed onto said beverage can, incorporating a vacuum seal, two friction fit seals and six captive seals.

4. The sanitary seal of claim 3 wherein:

a vacuum sealing interface is formed between said seal ring and said top end wall;

a first captive sealing interface is formed between said inner side wall and a side wall of said rim gutter;

a first and second friction fit sealing interface is formed with said wiper ring located between said seal ring and said inner side wall, a second captive sealing interface is formed between said horizontal lip and a top edge of said crimp rim:

a third captive sealing interface is formed between said outer ring and a side wall of the crimp rim;

a fourth captive sealing interface is formed between said capture band and a bottom edge of said crimp rim;

a fifth captive sealing interface is formed between said capture band and said can's upper band; and a sixth captive sealing interface is formed between said side wall skirt shield ring and said upper skirt.

5. A single use sanitary seal for a beverage can, said can having a bottom end wall connected to a cylindrical side wall that has an axially tapered; upper skirt adjacent an upper band that is affixed to a top end wall with a crimp rim where said top end wall has a rim gutter forming a circular trough around said top end wall, adjacent said crimp rim; said sanitary seal comprising:

a cylindrical body with a closed top thereon having an upward circular dome formed across an entire width of said closed top;

a generally planar, circular seal ring formed about a circumferential perimeter of said domed top;

an inner side wall extending upward at an angle from a circular edge of said circular seal ring;

a horizontal lip extending from a peripheral circular edge of said inner side wall;

a flange extending from said horizontal lip;

an axially tapered side wall skirt shield ring extending from said flange;

a corrugated-wiper ring that is a "U" shaped plug that is formed at the interface of said circular seal ring and said inner side wall, wherein said corrugated wiper ring is sized for frictional sealing engagement within said rim gutter of said beverage can, and wherein said flange has an outer ring which narrows and angles inward to form a smaller diameter capture band, and wherein said flange is dimensioned for complete contact with all external surfaces of said crimp rim, said outer ring contacting a circular exposed side wall of said crimp rim, and said capture band contacting a bottom edge of said crimp rim; and wherein said capture band also contacts said can's upper band and is dimensionally sized for engagement with a conventional six-pack ring.

6. The sanitary seal of claim 5 having nine separate sealing interfaces when placed onto said beverage can, incorporating a vacuum seal, two friction fit seals and six captive seals.

7. The sanitary seal of claim 6 wherein:

said vacuum sealing interface is formed between said seal ring and said top end wall;

a first captive sealing interface is formed between said inner side wall and a side wall of said rim gutter;

a first and second friction fit sealing interface is formed with a corrugated wiper ring which is a "U" shaped plug between said seal ring and said inner side wall, wherein said corrugated wiper ring forms said first and second friction fit sealing interfaces with said gutter;

a second captive sealing interface is formed between said horizontal lip and a top edge of said crimp rim:

a third captive sealing interface is formed between said outer ring and a side wall of the crimp rim;

a fourth captive sealing interface is formed between said capture band and a bottom edge of said crimp rim;

a fifth captive sealing interface is formed between said capture band and said can's upper band;

a sixth captive sealing interface is formed between said side wall skirt shield ring and said upper skirt.

* * * * *